US006758368B2

(12) United States Patent
Sarbo et al.

(10) Patent No.: US 6,758,368 B2
(45) Date of Patent: Jul. 6, 2004

(54) DISPOSABLE SHEET DISPENSER

(75) Inventors: Benjamin C. Sarbo, Winneconne, WI (US); Walter G. Bauer, Neenah, WI (US); Chi P. Duong, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/072,652

(22) Filed: Feb. 6, 2002

(65) Prior Publication Data

US 2003/0146231 A1 Aug. 7, 2003

(51) Int. Cl.[7] ..... B65H 1/00
(52) U.S. Cl. ..... 221/47; 221/63; 221/64
(58) Field of Search ..... 221/33, 45, 47, 221/48, 63, 64; 206/233, 494

(56) References Cited

U.S. PATENT DOCUMENTS

| | | | | |
|---|---|---|---|---|
| 1,773,652 | A | * | 8/1930 | Traver |
| 2,323,395 | A | * | 7/1943 | Harwood |
| 2,598,050 | A | * | 5/1952 | Guyer |
| 3,161,336 | A | | 12/1964 | Loescher |
| 3,239,097 | A | * | 3/1966 | Bates et al. |
| 3,325,003 | A | * | 6/1967 | Bilezerian |
| 3,369,698 | A | | 2/1968 | Scholz |
| 3,369,699 | A | | 2/1968 | Enloe et al. |
| 3,795,355 | A | | 3/1974 | Gerstein |
| 3,868,052 | A | | 2/1975 | Rockefeller |
| 3,994,417 | A | | 11/1976 | Boedecker |
| 4,017,002 | A | | 4/1977 | Doyle et al. |
| 4,469,243 | A | | 9/1984 | Ito et al. |
| 4,478,354 | A | | 10/1984 | Notheis |
| 4,513,862 | A | | 4/1985 | Mallow |
| 4,583,698 | A | | 4/1986 | Nistri et al. |
| 4,768,679 | A | | 9/1988 | Matsui |
| 4,785,970 | A | | 11/1988 | Engelmayer |
| 4,848,575 | A | | 7/1989 | Nakamura et al. |
| 4,856,725 | A | | 8/1989 | Bradley |
| 4,877,154 | A | | 10/1989 | Matsui |
| 5,219,421 | A | | 6/1993 | Tipping |
| 5,316,177 | A | | 5/1994 | Boldt |
| 5,582,294 | A | | 12/1996 | Yamada |
| 5,687,875 | A | | 11/1997 | Watts et al. |
| 5,740,913 | A | | 4/1998 | McFarland |
| 5,884,804 | A | | 3/1999 | King |
| 6,053,357 | A | | 4/2000 | Yoh |
| 6,202,889 | B1 | * | 3/2001 | Veith ..... 221/63 X |

FOREIGN PATENT DOCUMENTS

| | | |
|---|---|---|
| EP | 0577443 A1 | 1/1994 |
| EP | 0644130 B1 | 3/1995 |
| EP | 0955247 A1 | 11/1999 |
| EP | 1024090 A1 | 8/2000 |
| EP | 1072534 | 1/2001 |
| GB | 793745 | 4/1958 |
| WO | WO 9736527 | 10/1997 |
| WO | WO 9739964 | 10/1997 |
| WO | WO 9955599 | 11/1999 |
| WO | WO 0174694 | 10/2001 |

OTHER PUBLICATIONS

International Search Report, May 27, 2003.
U.S. patent application Ser. No. 09/747,720, filed Dec. 22, 2000.

* cited by examiner

*Primary Examiner*—David H. Bollinger
(74) *Attorney, Agent, or Firm*—Dority & Manning, P.A.

(57) ABSTRACT

A dispenser for dispensing interfolded disposable sheets is provided. The dispenser includes a flexible dispensing container that is configured to house the stack of interfolded disposable sheets. At least one side of the flexible dispensing container is flexible. The flexible dispensing container has a slit in one side from which sheets are dispensed from the flexible dispensing container. The flexible dispensing container has at least one end slit on an end of the slit. The end slit is configured to aid in the dispensing of the interfolded disposable sheets.

28 Claims, 5 Drawing Sheets

| | Slit Type | | | | | | | |
|---|---|---|---|---|---|---|---|---|
| Sheet Number | 5.5" Straight Slit 22 | 5.5" Current Slit | 5.5" S Slit 32 | 5.5" Straight Slit 22 and End Slit 24 | 5.5" Straight Slit 22 and End Slit 28 | 5.5" Slit 22 and End Slit 34 | 5.5" S Slit 32 and End Slit 28 | 5.5" Oval Slit 22 |
| 1 thru 5 | 50.6 | 47.9 | 50.0 | 36.3 | 42.6 | 49.7 | 38.7 | 47.9 |
| 6 thru 10 | 48.7 | 43.8 | 41.5 | 36.8 | 36.3 | 39.4 | 36.1 | 36.9 |
| 11 thru 15 | 45.5 | 45.8 | 41.1 | 30.1 | 33.3 | 37.4 | 31.1 | 32.6 |
| 16 thru 20 | 41.0 | 40.2 | 36.4 | 30.4 | 30.4 | 35.4 | 29.6 | 34.2 |
| 21 thru 25 | LIFT OFF | LIFT OFF | 34.4 | 29.3 | 30.5 | 33.6 | 29.8 | 29.8 |
| 26 thru 30 | LIFT OFF | LIFT OFF | LIFT OFF | LIFT OFF | LIFT OFF | LIFT OFF | 26.4 | 27 |
| 31 thru 35 | LIFT OFF | LIFT OFF | LIFT OFF | LIFT OFF | LIFT OFF | LIFT OFF | LIFT OFF | LIFT OFF |
| 36 thru 40 | LIFT OFF | LIFT OFF | LIFT OFF | LIFT OFF | LIFT OFF | LIFT OFF | LIFT OFF | LIFT OFF |
| 41 thru 45 | LIFT OFF | LIFT OFF | LIFT OFF | LIFT OFF | LIFT OFF | LIFT OFF | LIFT OFF | LIFT OFF |

| | Slit Type | | | | | | | |
|---|---|---|---|---|---|---|---|---|
| Sheet Number | 6.0 Straight Slit 22 | | 6.0" S Slit 32 | 6.0" Straight Slit 22 and End Slit 24 | 6.0" Straight Slit 22 and End Slit 28 | | 6.0" S Slit 32 and End Slit 28 | |
| 1 thru 5 | 47.1 | | 48.7 | 45.5 | 38.2 | | 30.4 | |
| 6 thru 10 | 41.9 | | 48.0 | 28.5 | 31.1 | | 27.5 | |
| 11 thru 15 | 39.2 | | 41.9 | 34.2 | 29.1 | | 28.5 | |
| 16 thru 20 | 35.6 | | 36.2 | 25.2 | 28.1 | | 26.1 | |
| 21 thru 25 | 31.8 | | 35.1 | 23.8 | 25.6 | | 23.7 | |
| 26 thru 30 | LIFT OFF | | LIFT OFF | 21.5 | 28.5 | | 25.3 | |
| 31 thru 35 | LIFT OFF | | LIFT OFF | 21.3 | LIFT OFF | | 20.9 | |
| 36 thru 40 | LIFT OFF | | LIFT OFF | LIFT OFF | LIFT OFF | | LIFT OFF | |
| 41 thru 45 | LIFT OFF | | LIFT OFF | LIFT OFF | LIFT OFF | | LIFT OFF | |

FIG.8

DISPOSABLE SHEET DISPENSER

BACKGROUND

Disposable sheet style dispensers are well known in the art for dispensing individual folded sheet products such as facial tissues, hand sheets, or the like. In general, disposable sheet dispensers typically include a container and a stack or clip of pre-folded, interfolded sheets disposed within the container. The sheets may be C-folded, V-folded, or flat so that once the top sheet in the clip is withdrawn, the underlying sheet is individually presented for subsequent use.

With one type of conventional product, a number of sheets are offered for sale in an interfolded format. The sheets are formed by unwinding two base rolls, perforating the sheets, and then interfolding the sheets into uniform stacks. The stacks of connected, perforated sheets are then loaded into corrugated cartons that allow for easy sheet access. In use, the sheets are dispensed through a fairly large oval or a smaller slit opening that is typically centrally located in the top panel of the carton.

To access the sheets, the user reaches into the carton through the opening to access the top sheet. The user then pulls the top sheet through the opening. Due to the sheets being connected at perforation tabs and interfolded one after another, the first sheet ideally pulls the second sheet to an accessible point and then breaks away from the second sheet. However, due to variability in the dimensions of the sheets, non-woven structure variability, size of perforation tabs, individual user "grasp and pull" methods, etc., continuous pulling of one sheet after another is typically not achieved. Additionally, these problems can also be present even if the sheets are not perforated but are simply interfolded one after another.

One of the more common problems found in disposable sheet dispensers concerns the issue of "fall back". This involves a situation where a following sheet drops back through the dispensing slot after the leading sheet has been withdrawn.

Another common problem among disposable sheet dispensers involves the issue of "double pull". This occurs when more than one sheet comes out when the leading sheet is withdrawn. Additionally, the problem of "streaming" can occur in disposable sheet dispensers. Streaming occurs when the user pulls the first sheet out, and subsequent sheets are also withdrawn, with separation of the following ones never occurring.

To overcome some of these problems, disposable sheet dispensers have been designed where the dispensing slot is a slit. Although slit shaped dispensing slots have worked well in eliminating some of these problems, they have inherent disadvantages. For instance, a pinch point is created on either end of a slit shaped dispensing slot. Upon dispensing sheets through the slit, the sheets can become wedged in these pinch points and cause the entire dispenser to be lifted into the air when one is trying to remove a sheet from the dispenser. Additionally, these pinch points can interfere with the dispensing of a sheet from the dispenser such that the sheet is caught on one or more pinch points which cause the sheet to tear.

Several designs are present for a dispensing slot used in a flexible disposable sheet dispenser. A flexible disposable sheet dispenser is different from a typical carton disposable sheet dispenser in that the flexible disposable sheet dispenser has walls that are not typically rigid. Also, the entire flexible disposable sheet dispenser typically takes the shape of the stack of disposable sheets within the flexible disposable sheet dispenser. The dispensing slot may be a slit as previously mentioned, or may be a hole. A slit is distinguished from a hole due to the area of the opening of the dispensing slot. In some instance, a slit may simply be a cut in the dispenser without removing any portion of the wall of the dispenser, while a hole is an opening in the dispenser that has a portion of the wall removed. However, slits may sometimes be openings that have a portion of the wall removed much like a hole. The slits used in flexible disposable sheet dispensers create pinch points. These pinch points create dispensing problems for the sheets as they are removed from the flexible disposable sheet dispenser.

A need in the art exists for a flexible disposable sheet dispenser that eliminates these problems and improves the performance of past flexible disposable sheet dispensers.

SUMMARY

Features and advantages of the invention will be set forth in part in the following description, or may be obvious from the description, or may be learned through practice of the invention.

An exemplary embodiment of the present invention provides for a dispenser for dispensing interfolded disposable sheets. The dispenser includes a flexible dispensing container that is configured to house the stack of interfolded disposable sheets. At least one side wall of the flexible dispensing container is flexible. The flexible dispensing container has a slit in one side from which sheets are dispensed. The flexible dispensing container also has an end slit on at least one end of the slit. The end slit is configured to aid in the dispensing of the interfolded disposable sheets.

Another exemplary embodiment of the present invention includes a dispenser for dispensing interfolded sheets that has a flexible dispensing container. The flexible dispensing container has a support wall that is configured for supporting a stack of interfolded disposable sheets. The support wall is contiguous with four side walls. The flexible dispensing container has a dispensing wall that is contiguous with the side walls. The dispensing wall has a slit with an end slit on at least one end of the slit. At least one of the walls is flexible. Also, the stack of interfolded disposable sheets are disposed within the flexible dispensing container and are supported by the support wall. The stack of interfolded disposable sheets are dispensed from the flexible dispensing container through the slit.

An additional exemplary embodiment of the present invention is provided that includes a dispenser for dispensing interfolded disposable sheets having a flexible dispensing container. The flexible dispensing container has a support wall that is configured for supporting a stack of interfolded disposable sheets. The support wall is contiguous with four side walls. Two of the side walls are of the same size and shape, and the other two of the side walls are of the same size and shape. A dispensing wall is contiguous with the side walls. The dispensing wall and the support wall are of the same size and shape. The dispensing wall has a slit located in substantially the center of the dispensing wall. The dispensing wall has end slits on either side of the slit, and all of the walls are flexible. Also, the stack of interfolded disposable sheets are disposed within the flexible dispensing container and are supported by the support wall. The stack of interfolded sheets are dispensed from the flexible dispensing container through the slit.

Alternatively, an exemplary embodiment of the present invention exists in a dispenser as discussed above where the slit is substantially a straight line, and the end slit is a substantially straight line substantially perpendicular to the slit.

Another exemplary embodiment of the present invention exists in a dispenser as discussed above where the slit is substantially a straight line and the end slit is angular in shape.

In addition, an exemplary embodiment of the present invention is provided in a dispenser as discussed above where the slit is substantially a straight line and the end slit has a curved portion.

Also provided in accordance with the present invention is an exemplary embodiment of a dispenser as discussed above where the slit has at least one curved portion and the end slit has a curved portion.

Also included in the present invention is an exemplary embodiment of a dispenser as discussed above where the slit is substantially a straight line and the end slit has at least two curved portions.

The present invention also includes an exemplary embodiment of a dispenser as discussed above where the flexible dispensing container has end slits on either end of the slit.

BRIEF DESCRIPTION OF THE DRAWINGS

An embodiment of the present invention is described by way of example with reference to the accompanying drawings, in which:

FIG. 8 is a chart showing the force needed to dispense certain sheets in accordance with a test conducted with several different exemplary embodiments of the present invention.

DETAILED DESCRIPTION

Figure 1:
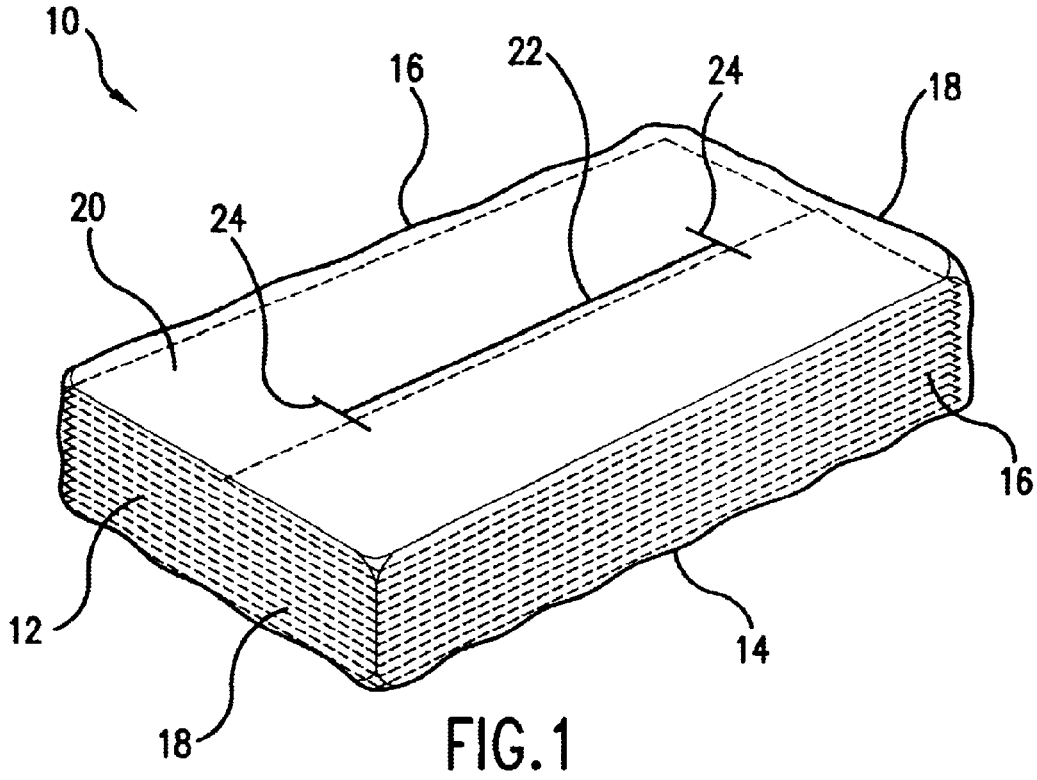
FIG. 1 is a perspective view of a dispenser in accordance with one exemplary embodiment of the present invention. The dispenser has a slit with two end slits on either end that are substantially perpendicular to the slit.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

Referring now to the drawings, FIG. 1 shows a dispenser 10 in accordance with one exemplary embodiment of the present invention. A clip of interfolded disposable sheets 12 is housed within the dispenser 10. The clip of interfolded disposable sheets 12 may be c-folded, v-folded, or configured with respect to one another by any means commonly known in the art. The dispenser 10 is comprised of a pair of sides or walls 18 that are contiguous with another pair of sides or walls 16. A support side or wall 14 is present and is in contact with the walls 16 and 18. The interfolded sheets 12 rests upon the support wall 14.

Also contiguous with the walls 16 and 18 is a dispensing side or wall 20. The dispensing wall 20 is provided with a slit 22. Slit 22 is shown in FIG. 1 as being substantially straight. Slit 22 may be made in the dispensing wall 20 by simply cutting the dispensing wall 20 without removing any portion of the dispensing wall 20. However, it is to be understood that as used here and as claimed in the claims, a "slit" may be an opening that has a portion of the wall removed and not simply a cut in the wall of the dispenser. In other words, "slit" is broad enough to cover a hole or other opening. The exemplary embodiment of the dispenser 10 shown in FIG. 1 has a pair of straight end slits 24 located on either end of the slit 22. The straight end slits 24 are substantially perpendicular to the slit 22.

Figure 2:
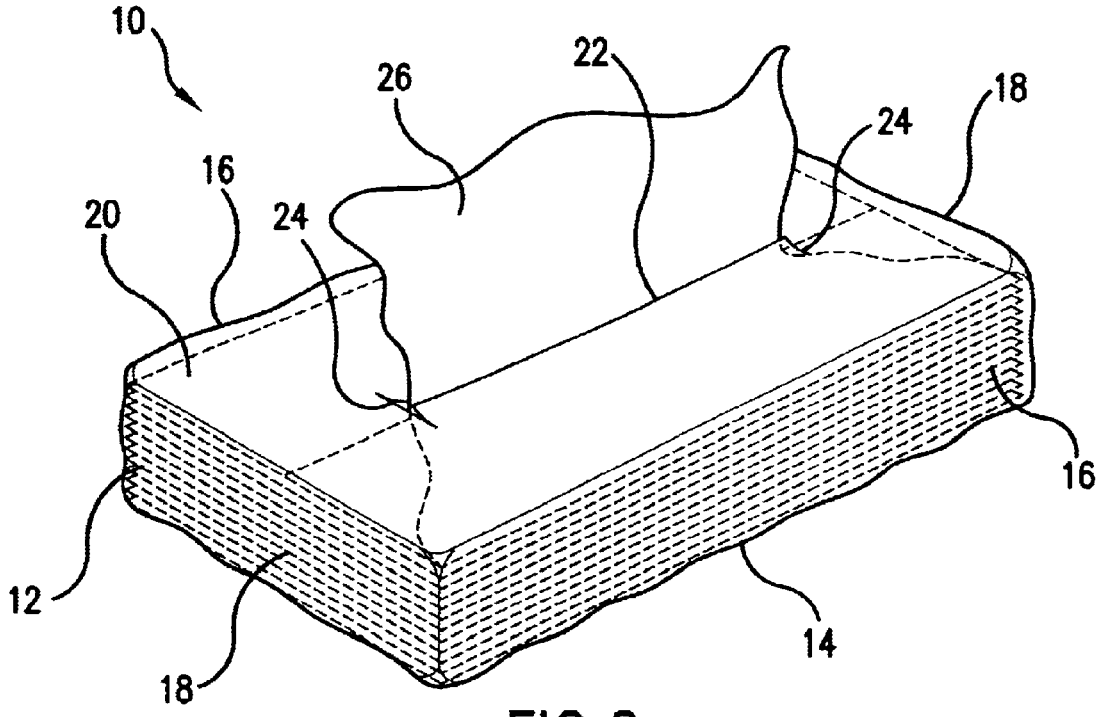
FIG. 2 is a perspective view of the dispenser shown in FIG. 1. A sheet is shown going through the slit and being located on the outside of the dispenser.

FIG. 2 shows the exemplary embodiment of the dispenser 10 of FIG. 1 with a sheet 26 being presented for use. Sheet 26 is shown going through the slit 22 and being presented for a user to grasp and pull. Once a user removes sheet 26 from the dispenser 10, a subsequent sheet will be "pulled up" by sheet 26 for subsequent use. This is a result of the interfolding between the sheets in the clip of interfolded disposable sheets 12.

The pair of straight end slits 24 improve the dispensing of the interfolded disposable sheets 12 from the dispenser. Provision of the straight end slits 24 eliminates pinch points that are present at either end of the slit 22. These pinch points could cause the entire dispenser 10 to be pulled upwards when a user grasps sheet 26 and attempts to remove the sheet 26 from the dispenser 10. This is because the pinch points may grab onto the sheet 26 at either one or both ends of the slit 22. In addition, the pinch points may also grab onto the sheet 26 and cause the sheet 26 to be torn during dispensing. The provision of the straight end slits 24 eliminates these pinch points from the dispenser 10, and eliminates the aforementioned problems. The provision of straight end slits 24 in conjunction with slit 22 may also act upon the sheet 26 in order to hold up the sheet 26 and prevent the sheet 26 from falling back into the dispenser 10. Additionally, there may be less friction between the sheet 26 and the dispensing wall 20 such that the entire dispenser 10 is not pulled up upon dispensing. However, it is to be understood that the present invention may be employed in instances where a "lift up" problem, a sheet 26 tear problem, or a "fallback" problem may not be present. The invention is not limited to solving the aforementioned problems. In addition, the straight end slits 24 provide areas to push the sheet 26 and further aid in the dispensing of the sheet 26 from the dispenser 10.

In an exemplary embodiment of the present invention, at least one of the walls 16, 18, 14, or 20 may be flexible in nature. In another exemplary embodiment of the present invention, all of the walls 14, 16, 18, and 20 are flexible. Having flexible walls allows for the dispenser 10 to essentially conform to the shape of the interfolded disposable sheets 12. This results in a dispenser 10 that is of a compact design and can be placed in areas unsuited to a dispenser that is rigid. The walls 16, 18, 14, and 20 may be made of, for instance, a plastic film and may be transparent in places. Additionally, writing or objects may be printed on or placed on the walls 16, 18, 14, and 20. The walls 16, 18, 14, and 20 may be a single piece or formed from several different pieces. If a single piece, it is possible for one sheet of material to form the entire dispenser 10. The walls 16, 18, 14, or 20 may be made out of, for example, polyethylene, polyester, or polypropylene.

Figure 3:
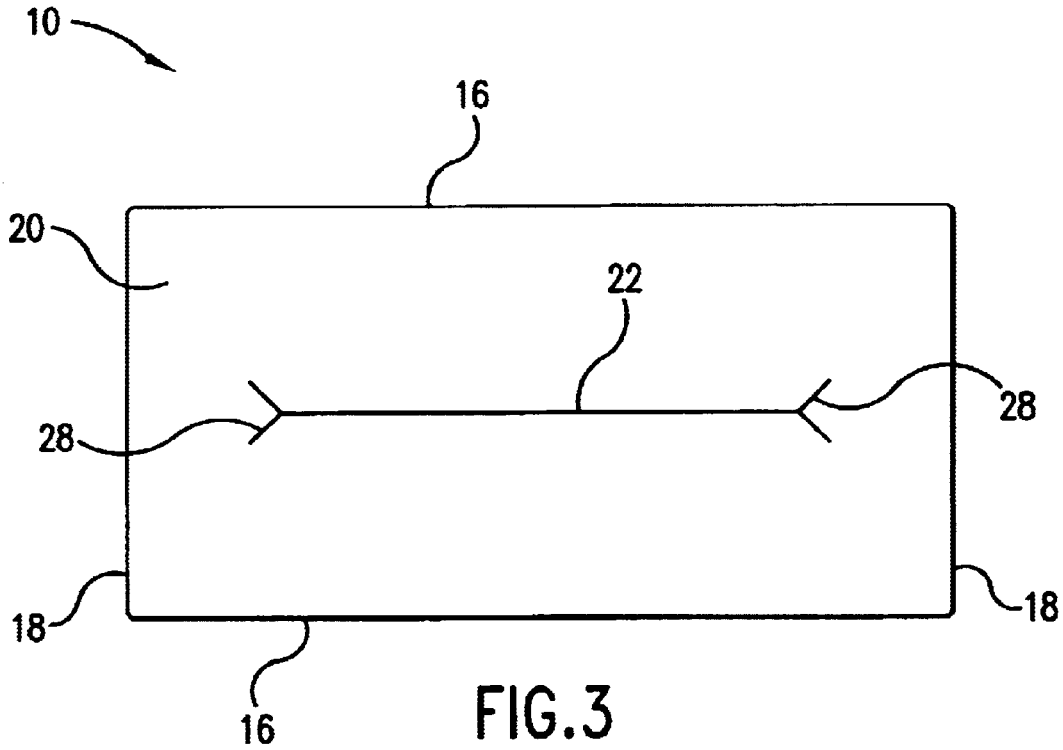
FIG. 3 is a top plan view of an exemplary embodiment of the present invention. A slit is present which has two end slits on either end that are angular in shape.

FIG. 3 shows another exemplary embodiment of a dispenser 10 in accordance with the present invention. Here, the slit 22 is again a substantially straight slit having end slits on either end. However, the end slits are angular end slits 28. The angular end slits 28 act to eliminate pinch points present if only a slit 22 were present. The angular end slits 28 may be made in a "V" like shape, the legs of the "V" being angled away from the slit 22. The legs of the angular end slits 28 do not need to be the same length or shape. Alternatively in another exemplary embodiment, the legs of the "V" may be angled toward the slit 22.

Figure 4:
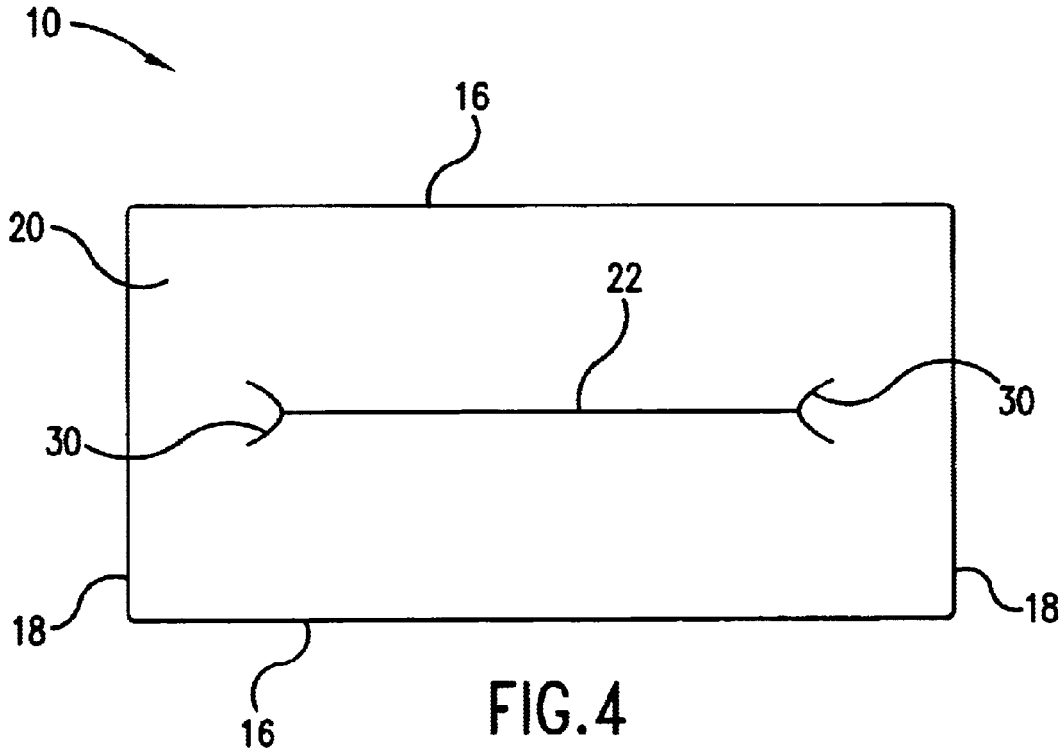
FIG. 4 is a top plan view of another exemplary embodiment of the present invention. A slit is present which has two end slits that are curved.

FIG. 4 shows another exemplary embodiment of the present invention where the end slits are curved end slits 30. Again, the curved end slits 30 eliminate pinch points that would be present if only slit 22 were present. The curved end slits 30 may be parabolic in shape. The curved end slit 30 does not have to be symmetric in size and shape, and may have some portions being of a different size and/or shape. The curved end slit 30 may be curved either toward or away from the slit 22.

Figure 5:
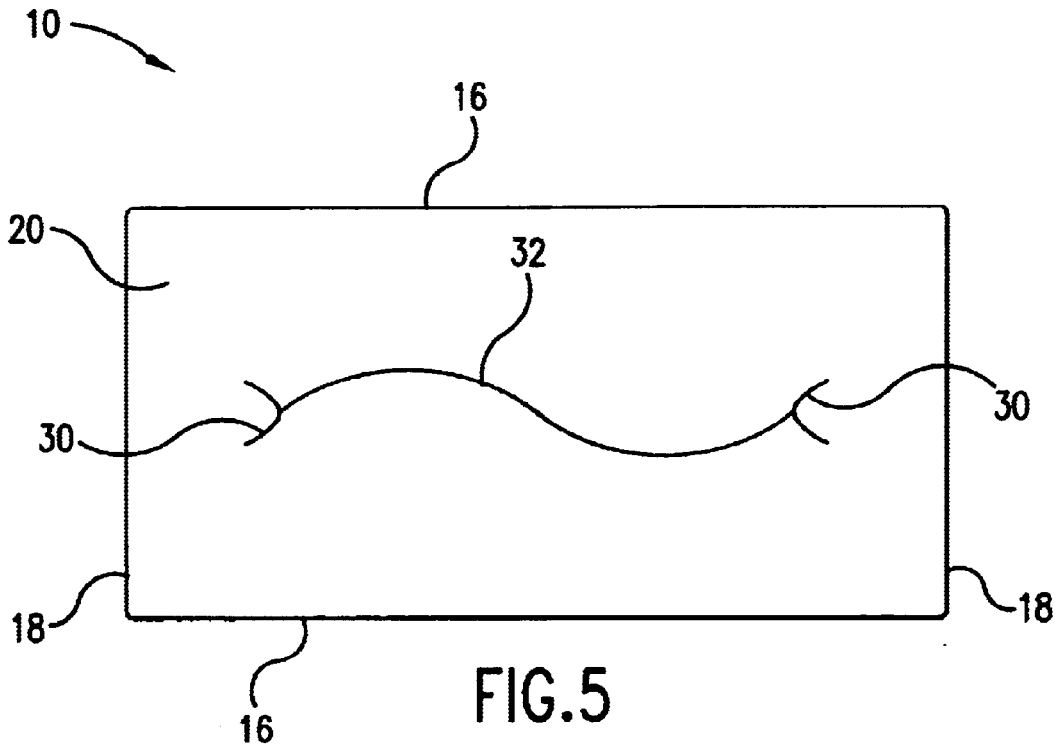
FIG. 5 is a top plan view of another exemplary embodiment of the present invention. A curved slit is present with two curved end slits on either end.

FIG. 5 shows another exemplary embodiment of the present invention where the slit 22 is replaced with a curved slit 32. On either end of the curved slit 32 are two curved end slits 30. The curved end slits 30 eliminate pinch points that would be present on either end of the curved slit 32 if only the curved slit 32 were present. The curved end slit 30 may be configured as discussed above.

Figure 6:
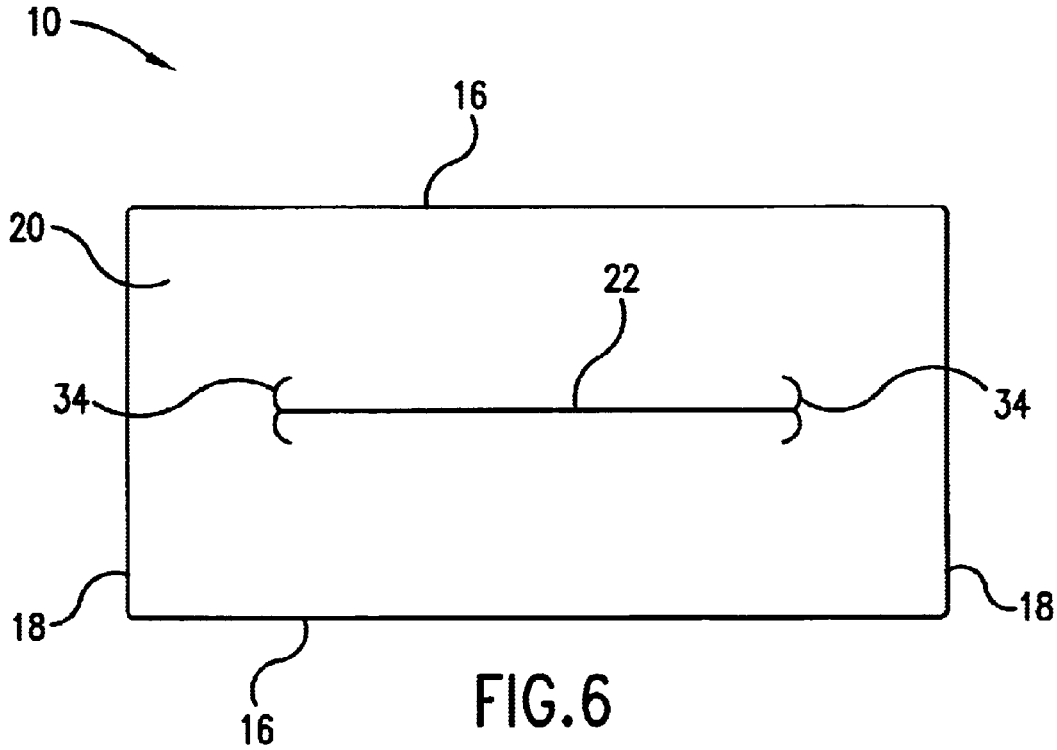
FIG. 6 is a top plan view of an exemplary embodiment of the present invention. A slit is present which has a double curved end slit on either end.

FIG. 6 shows an exemplary embodiment of the present invention having a slit 22 that is substantially straight. A pair of double curved end slits 34 are present on either end of the slit 22. The double curved end slits 34 provide for the elimination of pinch points on either end of the slit 22 if only the slit 22 were present. The double curved end slit 34 may be in the shape of two parabolic slits that have a common or touching leg. Each of the parabolic slits may face in the same or opposite direction, either away from or towards the slit 22. The double curved end slit 34 may be symmetric, or may have portions of different sizes and shapes.

In other exemplary embodiments of the present invention, other configurations of the slit 22, 32 and the end slits are envisioned. For instance, the exemplary embodiment shown in FIG. 5 may be modified such that a curved slit 32 is present having a pair of straight end slits 24 on either end. In fact, a variety of exemplary embodiments may be realized through the teaching of the present application. The slits 22 and 32 along with the end slits 24, 28, 30, and 34 shown are only exemplary of the teachings of the present application. Many different shapes and sizes of these slits are possible.

Slit 22 may be a series of perforations in other exemplary embodiments of the present invention. In addition, the end slits 24, 28, 30, and 34 may be perforated in some exemplary embodiments, or in other exemplary embodiments the end slits 24, 28, 30, and 34 may have only a perforation at the area of connection between themselves and slit 22. Various ways of perforating the slits 22, 24, 28, 30, and 34 may be used in practice of the present invention as is commonly known in the art. Also, the slits 22, 24, 28, 30, and 34 do not need to be perforated in other exemplary embodiments of the present invention.

In addition, it is not necessary to provide end slits at either end of the slit 22. For instance, in certain exemplary embodiments the slit 22 may be provided with only one straight end slit 24 on one end, the other end having no end slit. Again, the end slit does not have to be a straight end slit 24, but may be of other configurations. Additionally, the slits 22, 32 and end slits 24, 28, 30, and 34 do not have to be cuts in the dispensing wall or side 20, but may be openings in which a portion of the dispensing wall or side 20 is removed. The slit 22, 32 and end slits 24, 28, 30, and 34 may be holes or other openings besides a narrow slit. The end slits 24, 28, 30, and 34 may be circular or elliptical openings, or openings of other shapes or configurations. The same holds true for the slit 22, 32.

It should be understood that the invention includes various modifications that can be made to the exemplary embodiments of the improved disposable sheet dispenser described herein as come within the scope of the appended claims and their equivalents.

Test Results Involving Exemplary Embodiments of the Present Invention

Inventors have conducted tests in regard to the performance of the dispenser 10. One test takes into account the various methods by which a user will pull the sheet 26 from the dispenser 10. These different types of pulling techniques are utilized in pulling a sheet 26 from a dispenser 10 in which the dispenser 10 has only a slit 22, and in which the dispenser 10 has both a slit 22 and end slits 24. By using a variety of pulling methods, the test more accurately predicts how the dispenser 10 will function in everyday ordinary use as different consumers use different techniques with which to pull a sheet 26 from the dispenser 10. For instance, some users will grasp the sheet 26 in substantially the center of the sheet 26, while other users will grasp the sheet 26 on an end or corner. Additionally, some users may quickly pull the sheet 26 from the dispenser 10 while other users may slowly pull the sheet 26. The present test incorporates a variety of techniques and combines their results in order to more accurately determine the performance of the dispenser 10.

The results obtained in the test are the number of failures that occur with a dispenser 10 that has only a straight slit 22 and with one that has both a straight slit 22 and end slits 24. A failure is defined as a complete lift off, where upon pulling a sheet 26 the dispenser 10 is completely lifted from the surface upon which the dispenser 10 rests. A failure is also defined as a partial lift off, where the dispenser 10 is partially lifted from a surface upon the dispensing of the sheet 26.

The dispenser 10 used in this test is a polypack which is a dispenser 10 made of a flexible material. Each dispenser 10 contained 45 sheets 26. Ninety-six dispensers 10 were used, therefore the total number of sheets 26 which were dispensed were 4,320.

TABLE I

| Technique | Complete lift off, straight slit 22 | Complete lift off, straight slit 22 and end slits 24 | Partial lift off, straight slit 22 | Partial lift off, straight slit 22 and end slits 24 |
|---|---|---|---|---|
| 1. quick pull with tip fingers | 206 | 77 | 274 | 119 |
| 2. quick pull with full fingers | 226 | 82 | 213 | 116 |
| 3. quick snap with tip fingers | 155 | 52 | 147 | 93 |
| 4. quick pull with two fingers | 208 | 70 | 219 | 170 |

As can be seen in Table I, the number of failures categorized as a complete lift off of the dispenser 10 were reduced upon the employment of end slits 24 into the dispenser 10. Additionally, the number of partial lift offs were likewise reduced once the dispenser 10 was configured with end slits 24. The following table, Table II, combines the failures categorized as a complete lift off with those categorized as a partial lift off and classifies them as "total failures".

TABLE II

| | Straight slit 22 | Straight slit 22 and end slits 24 |
|---|---|---|
| Total Failures | 1648 | 779 |
| Percentage Failure | 0.381 | 0.180 |

The test conducted shows more than a 50% decrease in the number of partial and complete lift offs once the dispenser 10 is configured with end slits 24. As theorized by Applicants, the inclusion of end slits 24 result in an elimination of a pinch point that would otherwise occur at the end of a straight slit 22. As theorized, these pinch points more firmly grasp the sheet 26, and prevent them from being removed from the dispenser 10. The test shows that upon the elimination of these pinch points, sheets 26 may be more easily dispensed from the dispenser 10.

Additionally, Inventors have conducted a test involving the force needed to be applied in order to dispense a sheet 26 from a dispenser 10. This force was compared with the lift off weight of the dispenser 10 in order to determine if improved performance occurs upon the inclusion of end slits 22, 24, 28, 30, and 34.

The test involves placing a dispenser 10 on a flat surface and having a sheet 26 being positioned as if a user were ready to grasp and pull the sheet 26 from the dispenser 10. A Sintech 500S tensile tester, produced by MTS Systems Corp. of Research Triangle Park, N.C., was employed in order to make the force measurements in the test. A 10 Newton load cell was connected to the tensile tester and calibrated with 200 gram, 500 gram, and 700 gram weights. A grip on the tensile tester was set 5 inches above the flat surface onto which the dispenser 10 was resting. The jaws of the tensile tester were clamped onto the sheet 26. Each sheet 26 was dispensed until three consecutive lift offs occurred. A lift off was defined as occurring when the entire dispenser 10 was lifted from the flat surface onto which it originally rested. Sets of five sheets 26, that is the first five sheets 26 dispensed, the second five sheets 26 dispensed, the third five sheets 26 dispensed and so on, were then grouped and an average force of dispense was calculated.

FIG. 8 shows the results obtained after performing the aforementioned test. Results of the test are shown graphically in FIG. 7. As can be seen, the force to dispense sheets 26 was less when the dispenser 10 had both a slit 22 and end slits 24 as opposed to only a slit 22. For example, in order to dispense the first through the fifth sheet 26, a 5.5 inch straight slit 22 alone required 50.6 grams while the dispenser 10 having a 5.5 inch straight slit 22 and an end slit 24 required only 36.3 grams.

Figure 7:
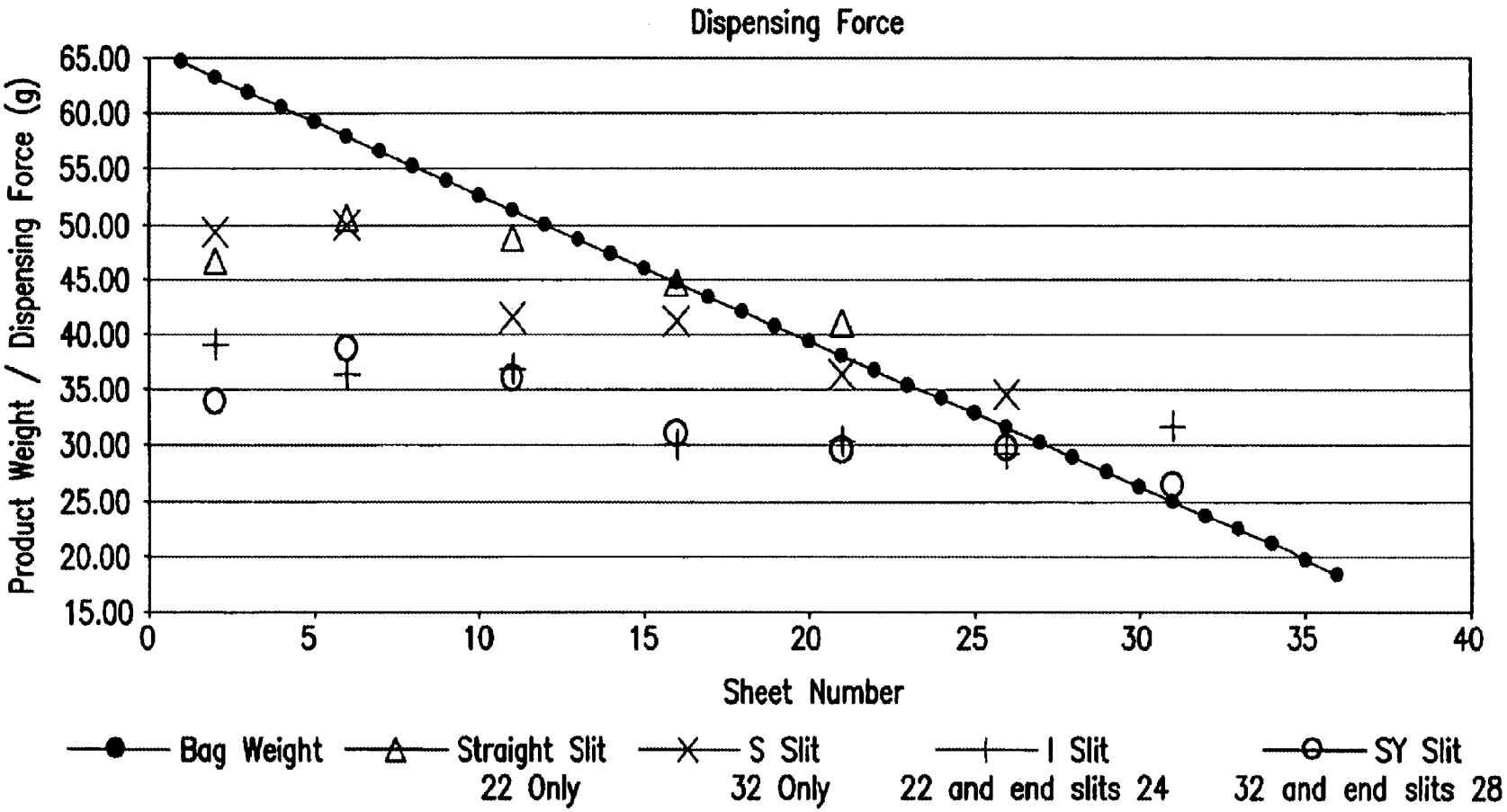
FIG. 7 is a graph of dispensing force versus sheet number in accordance with a test conducted with several different exemplary embodiments of the present invention.

FIG. 7 shows a line indicating the weight of the dispenser 10 with the sheets 26 therein. As can be seen, as the number of sheets 26 decreases, the weight of the dispenser 10 and sheets 26 likewise decreases. When the dispensing force is greater than the weight of the dispenser 10 and the sheets 26, the dispenser 10 will lift off from the surface onto which the dispenser 10 rests. Lift off will therefore occur anywhere to the right of the line indicated in FIG. 7. The end slits employed allow for a decrease in the dispensing force which therefore means that more sheets 26 may be dispensed before lift off occurs. For instance, in FIG. 7 the dispenser having only a straight slit 22 dispensed only 15 sheets before lift off occurred while the dispenser 10 having a curved slit 32 and end slits 28 dispensed 25 sheets 26 before lift off occurred.

Having a higher number of sheets 26 within the dispenser 10 will minimize the problem of lift off. This is because the dispenser 10 and sheets 26 will typically weigh a higher amount than the force needed to withdraw a sheet 26. Applicants have discovered that when a flexible plastic dispenser 10 is employed, the problem of lift off typically occurs once 30–35 sheets 26 remain. The end slits 24 significantly improve the problem of lift off.

What is claimed is:

1. A dispenser for dispensing interfolded disposable sheets comprising:

a flexible dispensing container configured to house the stack of interfolded disposable sheets and having a plurality of sides defining an interior space, at least two sides of said flexible dispensing container being flexible and at least one of said sides conforms to the shape of the stack of interfolded disposable sheets as the sheets are dispensed such that the volume of the interior space is reduced as the sheets are dispensed and the at least one side conforms to the shape of the stack of interfolded disposable sheets, said flexible dispensing container having a slit in one side from which sheets are dispensed from said flexible dispensing container, said flexible dispensing container having an end slit on at least one end of said slit, said end slit configured to aid in dispensing of the interfolded disposable sheets.

2. The dispenser as set forth in claim 1, wherein said slit is substantially a straight line and said end slit is a substantially straight line substantially perpendicular to said slit.

3. The dispenser as set forth in claim 1, wherein said slit is substantially a straight line and said end slit is angular in shape.

4. The dispenser as set forth in claim 3, wherein said end slit is in the shape of a V.

5. The dispenser as set forth in claim 1, wherein said slit is substantially a straight line and said end slit has a curved portion.

6. The dispenser as set forth in claim 1, wherein said slit is substantially a straight line and said end slit has at least two curved portions.

7. The dispenser as set forth in claim 1, further comprising a stack of interfolded disposable sheets disposed within said flexible dispensing container.

8. The dispenser as set forth in claim 1, wherein said flexible dispensing container is generally cube shaped.

9. The dispenser as set forth in claim 1, wherein said flexible dispensing container is generally rectangular shaped.

10. The dispenser as set forth in claim 1, wherein said flexible dispensing container has said end slits on either end of said slit.

11. The dispenser as set forth in claim 1, wherein said slit is located at the center of said side.

12. The dispenser as set forth in claim 1, wherein all of the sides of the flexible dispensing container are flexible.

13. A dispenser for dispensing interfolded disposable sheets comprising:

a flexible dispensing container configured to house the stack of interfolded disposable sheets, at least one side of said flexible dispensing container being flexible, said flexible dispensing container having a slit in one side from which sheets are dispensed from said flexible dispensing container, said flexible dispensing container having an end slit on at least one end of said slit, said end slit configured to aid in dispensing of the interfolded disposable sheets; and wherein said slit has at least one curved portion and said end slit has a curved portion.

14. A dispenser for dispensing interfolded disposable sheets comprising:

a flexible dispensing container configured to house the stack of interfolded disposable sheets, at least one side of said flexible dispensing container being flexible, said flexible dispensing container having a slit in one side from which sheets are dispensed from said flexible dispensing container, said flexible dispensing container having an end slit on at least one end of said slit, said end slit configured to aid in dispensing of the interfolded disposable sheets;

wherein said slit is substantially a straight line and said end slit has a curved portion; and wherein said end slit is parabolic in shape.

15. A dispenser for dispensing interfolded disposable sheets comprising:

a flexible dispensing container having a support wall configured for supporting a stack of interfolded disposable sheets, said support wall being contiguous with four side walls, said flexible dispensing container having a dispensing wall contiguous with said side walls, said dispensing wall having a slit and having an end slit on at least one end of said slit said support wall, side walls, and dispensing wall defining an interior space, at least two of said walls being flexible, and at least one of said walls conforms to the shape of said stack of interfolded disposable sheets as said sheets are dispensed such that the volume of the interior space is reduced as said sheets are dispensed and said at least one wall conforms to the shape of said stack of interfolded disposable sheets; and said stack of interfolded disposable sheets disposed within the interior space of said flexible dispensing container and supported by said support wall, said stack of interfolded disposable sheets are dispensed from said flexible dispensing container through said slit.

16. The dispenser as set forth in claim 15, wherein said slit is located at the center of said dispensing wall.

17. The dispenser as set forth in claim 15, wherein said slit is substantially a straight line and said end slit is a substantially straight line substantially perpendicular to said slit.

18. The dispenser as set forth in claim 15, wherein said slit is substantially a straight line and said end slit is angular in shape.

19. The dispenser as set forth in claim 18, wherein said end slit is V shaped.

20. The dispenser as set forth in claim 15, wherein said slit is substantially a straight line and said end slit has a curved portion.

21. The dispenser as set forth in claim 15, wherein said slit is substantially a straight line and said end slit has at least two curved portions.

22. The dispenser as set forth in claim 15, wherein said support wall, said four side walls, and said dispensing wall are all of equal size.

23. The dispenser as set forth in claim 15, wherein said support wall and said dispensing wall are of equal size and shape, and wherein two of said side walls are of equal size and shape and wherein the other two of said side walls are of equal size and shape.

24. The dispenser as set forth in claim 15, wherein said flexible dispensing container has said end slits on either end of said slit.

25. The dispenser as set forth in claim 15, wherein all of said walls of said flexible dispensing container are flexible.

26. A dispenser for dispensing interfolded disposable sheets comprising:

a flexible dispensing container having a support wall configured for supporting a stack of interfolded disposable sheets, said support wall being contiguous with four side walls, said flexible dispensing container having a dispensing wall contiguous with said side walls, said dispensing wall having a slit and having an end slit on at least one end of said slit, at least one of said walls being flexible; and said stack of interfolded disposable sheets disposed within said flexible dispensing container and supported by said support wall, said stack of interfolded disposable sheets are dispensed from said flexible dispensing container through said slit; and wherein said slit has at least one curved portion and said end slit has a curved portion.

27. A dispenser for dispensing interfolded disposable sheets comprising:

a flexible dispensing container having a support wall configured for supporting a stack of interfolded disposable sheets, said support wall being contiguous with four side walls, said flexible dispensing container having a dispensing wall contiguous with said side walls, said dispensing wall having a slit and having an end slit on at least one end of said slit, at least one of said walls being flexible; and said stack of interfolded disposable sheets disposed within said flexible dispensing container and supported by said support wall, said stack of interfolded disposable sheets are dispensed from said flexible dispensing container through said slit;

wherein said slit is substantially a straight line and said end slit has a curved portion; and wherein said end slit is parabolic in shape.

28. A dispenser for dispensing interfolded disposable sheets comprising:

a flexible dispensing container having a support wall configured for supporting a stack of interfolded disposable sheets, said support wall being contiguous with four side walls, two of said side walls are of the same size and shape and the other two of said side walls are of the same size and shape, a dispensing wall is contiguous with said side walls, said dispensing wall and said support wall are of the same size and shape, said dispensing wall having a slit located in substantially the center of said dispensing wall, said dispensing wall having end slits on either side of said slit, said support wall, side walls, and dispensing wall defining an interior space, all of said walls being flexible such that said flexible dispensing container conforms to the shape of said stack of interfolded disposable sheets as said sheets are dispensed such that the volume of the interior space is reduced as said sheets are dispensed and said flexible dispensing container conforms to the shape of said stack of interfolded disposable sheets; and said stack of interfolded disposable sheets disposed within the interior space of said flexible dispensing container and supported by said support wall, said stack of interfolded sheets are dispensed from said flexible dispensing container through said slit.

* * * * *